United States Patent [19]

Adell

[11] Patent Number: 4,841,104

[45] Date of Patent: Jun. 20, 1989

[54] ELECTRIC TOY TRAIN TRACK

[76] Inventor: Robert Adell, 200 Adell Blvd., Sunnyvale, Tex. 75182

[21] Appl. No.: 170,536

[22] Filed: Mar. 21, 1988

[51] Int. Cl.[4] ..... B60M 1/30

[52] U.S. Cl. ..... 191/29 R; 238/10 E

[58] Field of Search ..... 104/DIG. 1; 238/10 E, 238/10 A, 10 R, 264, 278, 283, 287, 289, 306, 382; 191/22 R, 29 R, 29 RM, 30

[56] References Cited

U.S. PATENT DOCUMENTS

| | | | |
|---|---|---|---|
| 526,963 | 10/1894 | Cattori | 191/29 X |
| 600,564 | 3/1898 | Walkins | 191/30 |
| 889,559 | 6/1908 | Tomlinson | 191/30 |
| 2,633,301 | 3/1953 | Esch | 238/10 E X |
| 3,806,672 | 4/1974 | Landis | 191/30 |

*Primary Examiner*—Johnny D. Cherry
*Assistant Examiner*—Gary C. Hoge

[57] ABSTRACT

An electric toy train track comprises a metal center rail on the base of which electrical insulating material has been extruded prior to roll-forming of the metal to the transverse shape for the rail. The center rail comprises in transverse cross section a horizontal base, an upright centrally supported on the base and a generally circular annular portion atop the upright that forms the top of the rail. The base has a bottom, sides, and a top. The electrical insulation is disposed in covering relation to the bottom and sides of the base and at least a portion of the top of the base immediately contiguous each side. The insulation is disposed on the base as two separate and discrete zones, one zone to one side of the upright and the other zone to the other side of the upright. The zones of insulation are separated at the bottom of the base by a gap that is disposed directly below the upright. The power rail is part of a toy train track that comprises parallel rails to each side of the power rail and metal cross ties which hold the three rails in assembly. The rails lie across the tops of the cross ties. Tabs on the cross ties hold the rails against the tops of the cross ties. The insulation on the power rail insulates the power rail from the cross ties.

1 Claim, 2 Drawing Sheets

ELECTRIC TOY TRAIN TRACK

BACKGROUND AND SUMMARY OF THE INVENTION

This invention relates to an electric toy train track that has a rail that delivers electric current to a train that runs on the track.

Conventional "O" gauge type track comprises three parallel metal rails that are joined in laterally spaced apart relation to each other by means of metal cross ties. The center rail is the "hot" rail that carries electric current to the train.

In order to avoid potential short circuiting of the electric current through a cross tie, it is necessary that a non-metallic insulator be placed in the joint between each cross tie and the center power rail for the purpose of electrically insulating the center power rail from the cross tie. These insulators are small, loose pieces that are placed between the cross tie and the center rail prior to their being joined. Joining is performed by placing the center rail onto a cross tie so that the base of the rail rests on an intervening insulator; then, tabs of the cross tie adjacent the sides of the rail's base are clinched and crimped against the base, mechanically joining the cross tie and the rail while causing the insulator to wrap around the sides and top of the base and become entrapped in the joint.

That method for fabricating tracks involves a considerable amount of manual labor, especially in placement of the insulators onto the cross ties. The width of an insulator is just large enough to fully span the width of the cross tie's top platform surface against which the base of the rail is disposed sandwiching the insulator in-between. Improper placement of an insulator can give rise to the potential for shorting of the power rail to the cross tie thereby shorting electrical current from the toy train.

Thus, during fabrication of the track, extreme care must be taken both in placement of the insulators between the power rail and the cross ties and also in the joining procedure to make sure that the insulation is ultimately in the proper place. Since this prior procedure uses manual labor, the possibility that defective parts will be produced is real. If these defective parts are caught before they reach the consumer, that is one thing, but if they reach the consumer, they can lead to disappointment and frustration for what is intended to be a pleasurable and enjoyable hobby, especially for young people.

The need for placing a small insulator piece between the power rail and each cross tie is a further disadvantage because it renders the fabrication poorly suited for automated assembly operations which otherwise could improve the efficiency of mass-producing the track.

The present invention is directed to a new and improved toy train track of the aforedescribed type which eliminates these small insulator pieces and the attendant criticality in their placement between the power rail and the cross ties. Moreover, the invention has the advantage of providing insulation throughout the entire length of the power rail, not just at each cross tie.

The invention is practiced, in the preferred embodiment, by extruding an inexpensive non-metallic electric insulating material, PVC plastic for example, onto the metal piece that forms the structure of the power rail. The rail is formed from a flat metal strip by conventional forming procedures (i.e. roll-forming) to produce the desired cross sectional shape for the rail. In this cross sectional shape, the extruded electric insulating material covers the bottom of the base of the rail, the sides of the base, and portions of the top of the base immediately contiguous the sides, and the insulation is continuous throughout the length of the rail.

When the rail is assembled to cross ties to form the track, the rail's base is simply placed against the cross ties' top platform surfaces, and then the adjacent tabs of the cross ties are clinched and crimped against the base thereby securely joining the two parts in an insulated manner so that there is no electrical conductivity between them. In this way, the power rail is insulated from the cross ties by a procedure that is not dependent upon the manual placement of small individual insulator pieces between the cross ties and the power rail. Advantages are that the assembly is well-suited for automated fabrication because the small insulator pieces are eliminated, and that the potential for defective parts due to improperly placed insulators is minimized.

The foregoing features, advantages and benefits of the invention, along with additional ones, will be seen in the ensuing description and claims which should be considered in conjunction with the accompanying drawings. The drawings disclose a preferred embodiment according to the best mode contemplated at the present time in carrying out the invention.

DESCRIPTION OF THE PREFERRED EMBODIMENT

Figure 1:
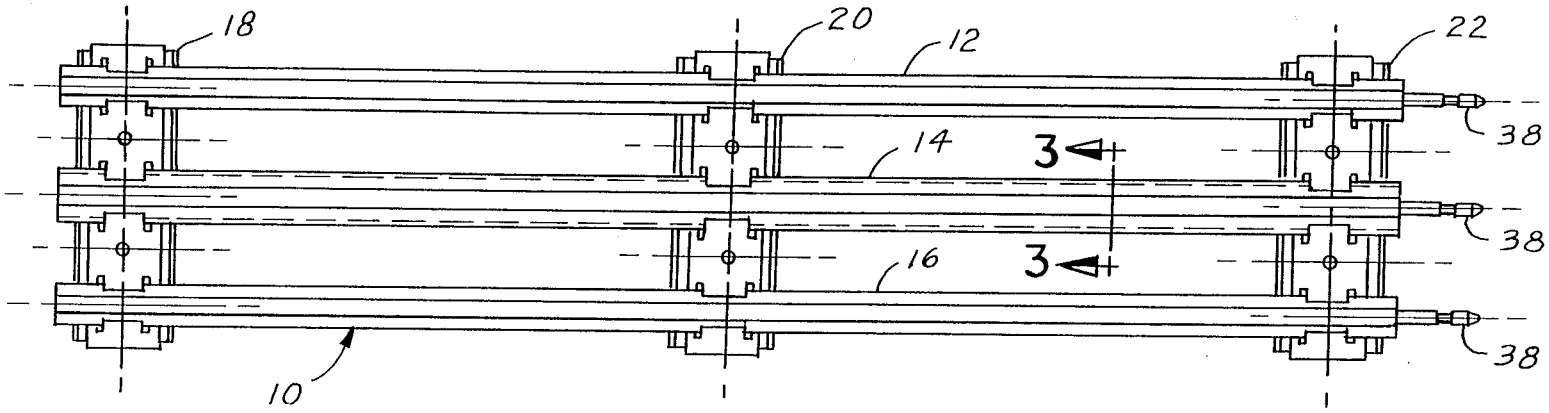
FIG. 1 is a top plan view of an electric toy train track embodying principles of the invention.
Figure 2:
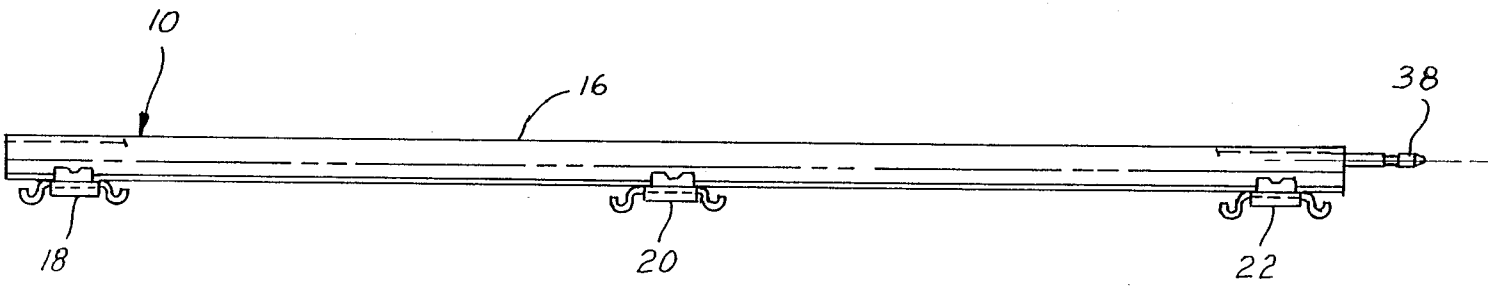
FIG. 2 is a side elevational view of the track of FIG.

Track 10 comprises three metal rails 12, 14, 16 and three metal cross ties 18, 20, 22. Rail 14 is the power rail for conducting electric current to a train that rides on the track. It comprises a metal strip 24 that is formed into the illustrated cross sectional shape and electrical insulation 26 which serves to insulate the metal of the rail from the underlying metal cross ties 18, 20, 22 in the assembled track. Rails 12 and 16 need not be insulated, and therefore each comprises a transverse cross sectional shape that is the same as that of the formed metal strip 24 that constitutes rail 14, but with insulation 26 being omitted.

The three rails 12, 14, 16 are of equal lengths and are disposed in uniformly spaced apart parallel relationship. The basic features of each rail comprise a base, 28 generally, and an upright, 30 generally, that is centrally supported on base 28. Upright 30 comprises flat confronting portions 32 extending uprightly from base 28 and leading to a generally circular annular portion 34 that forms the top of the rail.

Portion 34 is shaped to accommodate wheels of the train that rides upon the track, and also to form generally circular receptacle spaces 36 that are open at opposite ends of each rail. In track 10, metal connector pins 38 are pressed into the rails at one end and project outwardly therefrom for separable mating connection with receptacles 36 in the opposite end of respective rails of another like piece of track (not shown) that is to be connected to track 10. In this way, multiple tracks are connected together, and such tracks may have a straight shape, as portrayed by the drawings, or a curved shape (not shown).

Each cross tie 18, 20, 22 is a stamped metal part that has a generally overall rectangular shape. The cross tie comprises a horizontal platform 40 that is supported in upwardly spaced relation from the bottom of the track by curled lips 42 that depend from the longer sides of the cross tie. Flanges 44 are also turned downward along the shorter sides.

Platform 40 further contains three pairs 46, 48, 50 of upright tabs that are formed during stamping of the cross tie by displacing material upwardly from the platform. As such, each pair of tabs joins with the platform along opposite sides of a corresponding rectangular hole 52, 54, 56 through the platform. The center pair of tabs 48 are spaced apart slightly farther than the spacing distance of the tabs of the other two pairs 46, 50. As will become apparent from subsequent description, each pair of tabs is used to secure a corresponding rail to the cross ties during assembly of the track, but first attention is directed to further inventive details retailing to the fabrication of rail 14.

Figure 3:
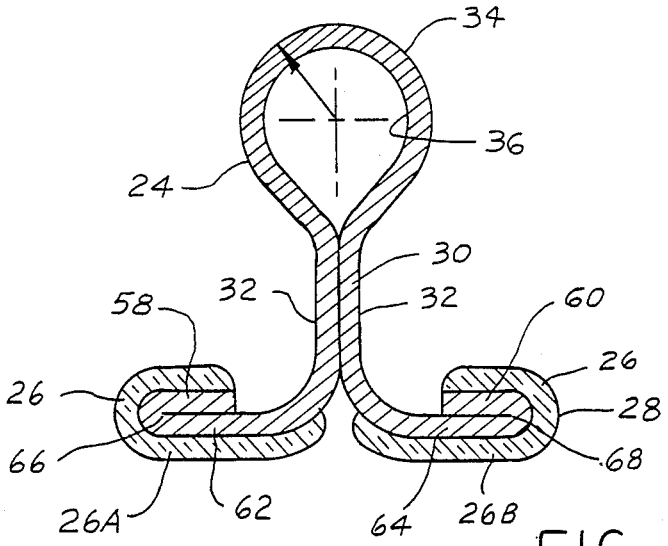
FIG. 3 is an enlarged transverse cross sectional view taken in the direction of arrows 3—3 in FIG. 1.
Figure 7:
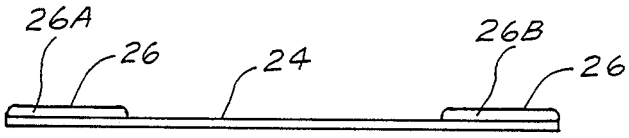
FIG. 7 is an end view of the power rail prior to fabrication thereof into the cross sectional shape portrayed by FIG. 3.
Figure 4:
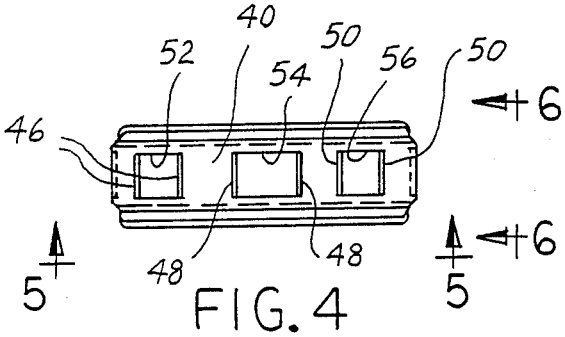
FIG. 4 is a top plan view of a cross tie that is used in the track of FIG. 1 before rails are attached to it.
Figure 5:
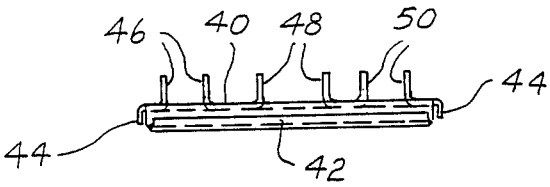
FIG. 5 is a view of the cross tie looking in the direction of arrows 5—5 in FIG. 4.
Figure 6:
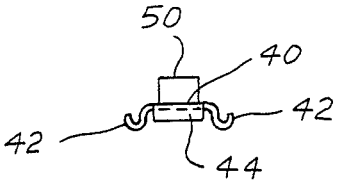
FIG. 6 is a view of the cross tie looking in the direction of arrows 6—6 in FIG. 4.

FIG. 3 shows the finished rail to comprise the insulation 26 disposed in two separate and discrete zones 26A, 26B. The cooperative effect of these zones is however to cover the extent of the rail's base that would otherwise be in direct abutment with the cross tie, to cover the sides of the rail's base and to cover at least a portion of the top of the base that is immediately contiguous each side.

According to the invention, rail 14 is fabricated from a length of flat metal strip 24 which is of suitable thickness and material to serve the intended purpose. For example, 0.015 inch thick tinplate cold rolled steel is quite satisfactory. The two zones of insulating material 26A, 26B are applied to one side only of metal strip 24 immediately adjacent the side edges of the strip. This insulating material is preferably PVC plastic and has a thickness essentially the same as that of strip 24. Each zone 26A, 26B has substantially the same width as the other across the strip, and each covers a corresponding marginal portion of the strip on one side thereof immediately contiguous the corresponding strip edge.

The preferred process for applying the insulation to the metal strip comprises passing the metal strip through an extruder and at the extruding head depositing the extruded plastic, by means of a suitable extruding die, as discrete layers onto the margins of the metal strip. Thus, the insulation extends continuously along the length of the strip so that it will similarly extend continuously along the length of the finished rail.

The partially insulated metal strip is then further processed by conventional procedures, roll-forming being the typical procedure, to produce the illustrated cross sectional shape of FIG. 3. Although the insulation is applied to only one side of the metal strip, the resulting cross sectional shape of the rail comprises the insulation covering the bottom of base 28, the sides of the base, and the immediately contiguous portions of the top of the base. This construction is achieved by folding an outer portion 58, 60 of each margin back against an inner portion 62, 64 of the same margin about a corresponding line of folding 66 68 located on the uninsulated side of the metal strip. As can be seen in FIG. S, the width of the insulation across the top of the base is approximately half of the width extending across the bottom of the base on each side of the rail. Preferably, the roll-forming places the folded portions 58, 60 in substantially full metal-to-metal contact with portions 62, 64 so that the insulation extending across the top of the base is essentially parallel with that which underlies the base.

The finished rail 14 is now ready to be assembled to the cross ties. This is done by placing the insulated base of the rail on the platforms 40 so that it fits between each pair of tabs 48. The tabs are then clinched and crimped against the insulation on the top of the base. The insulation on the bottom of the base insulates the rail from the cross tie platform while the insulation that is on the sides and top of the base insulates the rail from the tabs. In this way, the rail is fully electrically insulated from the metal cross ties.

Moreover, the insulation extends along the full length of the base of the power rail so that there is a reduced likelihood of shorting of the power rail to any stray objects that might otherwise be in contact with its base, a further advantage of the invention. In the prior construction described earlier, the portion of the power rail extending between the cross ties was uninsulated, such insulation being only in the joints between the power rail and the cross ties.

Because the insulation is extruded onto the metal strip it is tenaciously bonded to the metal and is inherently accurately located on the rail. Thus, when the rail is assembled onto the cross ties, there is no need to manipulate small pieces of insulation in precise positions in the joints between the rail and cross ties to achieve the desired insulating effect. The present invention, in addition to yielding a superior product per se, greatly facilitates the fabrication of the product because it is much more conducive to automated assembly procedures than the prior technique of insulating the power rail through the use of small individual pieces of insulation.

While a preferred embodiment of the invention has been disclosed, it will be appreciated that principles are applicable to other embodiments.

I claim:

1. An electric toy train track power rail comprising a length of a formed conductive metal strip to which electrical insulation has been selectively applied continuously along the length thereof such that in transverse view the power rail comprises a horizontal base having a bottom, sides, and a top, and an upright centrally supported on the base to provide electrical continuity to an electric toy train that runs on a track that contains the power rail, said electrical insulation being disposed in covering relation to the bottom and sides of the base and in covering relation to at least a portion of the top of the base immediately contiguous each side, in which the base is defined by longitudinal margins of the metal strip and said insulation is disposed as two separate and discrete zones, one zone for one margin, the other zone for the other margin, said zones being separated at the bottom of said base by a gap that is disposed directly below said upright.

* * * * *